US010356856B2

(12) United States Patent
Chen

(10) Patent No.: US 10,356,856 B2
(45) Date of Patent: Jul. 16, 2019

(54) CAPACITOR STEP-DOWN LED DRIVER AND DRIVING METHOD USING THE SAME

(71) Applicant: Silergy Semiconductor Technology (Hangzhou) Ltd., Hangzhou (CN)

(72) Inventor: Wei Chen, Hangzhou (CN)

(73) Assignee: SILERGY SEMICONDUCTOR TECHNOLOGY (HANGZHOU) LTD., Hangzhou (CN)

( * ) Notice: Subject to any disclaimer, the term of this patent is extended or adjusted under 35 U.S.C. 154(b) by 631 days.

(21) Appl. No.: 14/475,680

(22) Filed: Sep. 3, 2014

(65) Prior Publication Data

US 2015/0061523 A1 Mar. 5, 2015

(30) Foreign Application Priority Data

Sep. 3, 2013 (CN) ..... 2013 1 0395919

(51) Int. Cl.
*H05B 33/08* (2006.01)

(52) U.S. Cl.
CPC ..... *H05B 33/0815* (2013.01)

(58) Field of Classification Search
CPC ..... F21V 29/503; F21V 23/0605; H05B 37/0272; H05B 33/089
USPC ..... 315/307, 291, 200 R, 227 R
See application file for complete search history.

(56) References Cited

U.S. PATENT DOCUMENTS 6,343,871 B1 * 2/2002 Yu ..... G09F 13/04 362/249.03
7,852,017 B1 * 12/2010 Melanson ..... H05B 33/0815 315/185 S
2010/0244788 A1 * 9/2010 Chen ..... H02M 3/1584 323/234
2011/0309759 A1 * 12/2011 Shteynberg ..... H05B 33/0815 315/201
2012/0074845 A1 * 3/2012 Aoki ..... H05B 33/0845 315/119
2012/0146525 A1 * 6/2012 Hui ..... H05B 33/0809 315/200 R
2013/0221867 A1 * 8/2013 Deppe ..... H05B 33/0809 315/224

FOREIGN PATENT DOCUMENTS

CN 103152949 A 6/2013

* cited by examiner

*Primary Examiner* — Douglas W Owens
*Assistant Examiner* — Amy X Yang
(74) *Attorney, Agent, or Firm* — Westman, Champlin & Koehler, P.A.

(57) ABSTRACT

The present disclosure relates to a capacitor step-down LED driver and a driving method using the same. A capacitor step-down LED driver comprises a control circuit and a switching circuit. The control circuit turns on or off the switching circuit in response to an output current and an output voltage of the capacitor step-down LED driver, and thus controls an amount of energy supplied from an input side to an output side. In a first operation state, the switching circuit is controlled not to supply energy from the input side to the output side. In a second operation state, the switching circuit is controlled to supply energy from the input side to the output side. Thus, the output current is maintained to be a value of a desired driving current.

18 Claims, 6 Drawing Sheets

CAPACITOR STEP-DOWN LED DRIVER AND DRIVING METHOD USING THE SAME

RELATED APPLICATIONS

This application claims the benefit of Chinese Patent Application No. 201310395919.0, filed on Sep. 3, 2013, which is incorporated herein by reference in its entirety.

TECHNICAL FIELD

The present disclosure generally relates to the field of electronics, and more specifically, to a capacitor step-down LED driver and a driving method using the same.

BACKGROUND

LED lamps are now widely used and LED driving technology is also well known. There are many approaches for driving LEDs in the prior art, including, for example, PWM constant current driving approach and capacitor step-down LED driving circuit. The PWM constant current driving approach provides a good constant control on an output current. Thus, many constant current control chips are commercially available. However, this kind of driving approach is very expensive and very complex, and results in difficulties in circuit design. The capacitor step-down LED driving circuit is simple and cheap, and thus is widely used as a low-power LED lighting driving circuit.

A schematic diagram of a capacitor step-down LED driving circuit according to the prior art is shown in FIG. 1. According to the principle that a capacitive reactance limits a current, an AC power supply $V_{ac}$ drops after passing an input capacitor $C_{in}$, and is then supplied to an rectifier circuit 11. The rectifier circuit 11 outputs a DC voltage, which is filtered by an output capacitor $C_{out}$ and then supplied to a LED load as an output voltage. A resistor $R_1$ is coupled in parallel with an input capacitor $C_{in}$, and provides a path for discharging the input capacitor $C_{in}$ when the AC power supply is turned off.

In the capacitor step-down LED driving circuit according to the prior art as shown in FIG. 1, an output current, which is also a LED driving current, varies greatly with the input capacitor $C_{in}$ and the AC power supply $V_{ac}$. Consequently, the LED has an unstable brightness. Moreover, the LED driving current depends on a value of the input capacitor $C_{in}$. The LED driving current decreases when a capacitance value of the input capacitor $C_{in}$ decreases. Consequently, the LED has a decreased brightness. A design scheme of the capacitor step-down LED driving circuit according to the prior art cannot ensure stability of the LED load because the output voltage decreases significantly when the LED load increases. The output capacitor $C_{out}$ explodes when the AC power supply is excessively high. Moreover, the capacitor step-down LED driving circuit according to the prior art has many safety problems because it lacks surge current limitation, output short circuit protection and open circuit protection.

SUMMARY

In view of this, one object of the present disclosure is to provide a novel capacitor step-down LED driver and a method using the same, to solve the problems of poor stability, short lifetime and low efficiency of the capacitor step-down LED driver according to the prior art.

According to one aspect of the present disclosure, there is provided a capacitor step-down LED driver for receiving an AC power supply at an input side and generating an output voltage and an output current at an output side to drive a LED load, comprising an input capacitor, a rectifier circuit, an output capacitor, a control circuit and a switching circuit, wherein a first terminal of the input capacitor is coupled to a first terminal of the AC power supply, a second terminal of the input capacitor is coupled to a first input terminal of the rectifier circuit, and a second input terminal of the rectifier circuit is coupled to a second terminal of the AC power supply;

the output capacitor is coupled in parallel to the LED load;

the switching circuit is coupled between an output terminal of the rectifier circuit and the output capacitor;

the control circuit turns on or off the switching circuit in response to the output current, and thus controls an amount of energy supplied from the input side to the output side;

the switching circuit is controlled not to supply energy from the input side to the output side in a first operation state that the output current is larger than a desired driving current; and the switching circuit is controlled to supply energy from the input side to the output side in a second operation state that the output current is less than the desired driving current to maintain the output current to be a value of the desired driving current.

Preferably, the switching circuit comprises a first switch coupled between two output terminals of the rectifier circuit, and the first switch is turned on in the first operation state and is turned off in the second operation state.

Preferably, the switching circuit further comprises a second switch coupled in series between the first switch and the output capacitor, and the second switch is turned on when a rectified output voltage of the rectifier circuit is larger than the output voltage in the second operation state.

Preferably, the second switch comprises a diode or a controllable switch.

Preferably, the control circuit comprises a zero-crossing signal generating circuit and an OFF signal generating circuit;

the zero-crossing signal generating circuit generates a zero-crossing signal in response to an input voltage of the rectifier circuit of the capacitor step-down LED driver, and the switching circuit prevents energy from being supplied from the input side to the output side in response to the zero-crossing signal when the input voltage crosses zero; and the OFF signal generating circuit generates an OFF signal after a time period in accordance with an error between the current output current and the desired driving current, to allow energy to be supplied from the input side to the output side.

According to another aspect of the present disclosure, there is provided a driving method using a capacitor step-down LED driver to generate an output voltage and an output current for driving a LED load, comprising comparing the output current and a desired driving current;

preventing energy from being supplied from an input side to an output side of the capacitor step-down LED driver when the output current is larger than the desired driving current; and supplying energy from the input side to the output side to maintain the output current to be a value of the desired driving current when the output current is less than the desired driving current.

Preferably, the step of supplying energy from the input side to the output side further comprises:

comparing a rectified output voltage of the capacitor step-down LED driver and the output voltage;

preventing energy from being supplied from the input side to the output side when the rectified output voltage is less than the output voltage;

supplying energy from the input side to the output side to maintain the output current to be a value of the desired driving current when the rectified output voltage is larger than the output voltage.

Preferably, the step of preventing energy from being supplied from the input side to the output side further comprises:

detecting an input voltage of the rectifier circuit of the capacitor step-down LED driver;

preventing energy from being supplied from the input side to the output side from the moment the input voltage crosses zero; and supplying energy from the input side to the output side after a time period indicative of an error between the current output current and the desired driving current has elapsed.

The capacitor step-down LED driver and the driving method using the same according to the embodiments of the present disclosure control energy supplied from the input side to the output side in accordance with the current state of the LED load. For example, the capacitor step-down LED driver is controlled not to supply energy from the input side to the output side when the driving current is larger than the desired driving current, and is controlled to supply energy from the input side to the output side when the driving current of the LED is less than a reference current. The above feedback control adjusts the LED driving current in real-time response to an output electrical signal at the output side, and accurately controls the output signal while the load requirement is fulfilled. This feedback control reduces power loss and improves operating efficiency. Meanwhile, variations of the AC power supply and the input capacitor will not change the LED driving current, resulting in increased stability and lifetime of the circuit. Furthermore, the reliability of the circuit is also improved by the short circuit protection and open circuit protection for the LED and the overvoltage protection for the input voltage (the AC power supply).

DESCRIPTION OF EMBODIMENTS

Reference will now be made in detail to particular embodiments of the disclosure, examples of which are illustrated in the accompanying drawings. While the disclosure will be described in conjunction with the preferred embodiments, it will be understood that they are not intended to limit the disclosure to these embodiments. On the contrary, the disclosure is intended to cover alternatives, modifications and equivalents that may be included within the spirit and scope of the disclosure as defined by the appended claims. Furthermore, in the following detailed description of the present disclosure, numerous specific details are set forth in order to provide a thorough understanding of the present disclosure. However, it will be readily apparent to one skilled in the art that the present disclosure may be practiced without these specific details.

Figure 1:
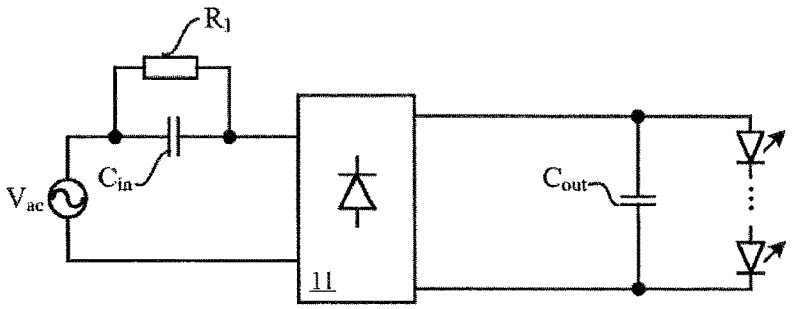
FIG. 1 (PRIOR ART)
FIG. 1 illustrates a schematic block diagram of a capacitor step-down LED driving circuit according to the prior art.
Figure 2:
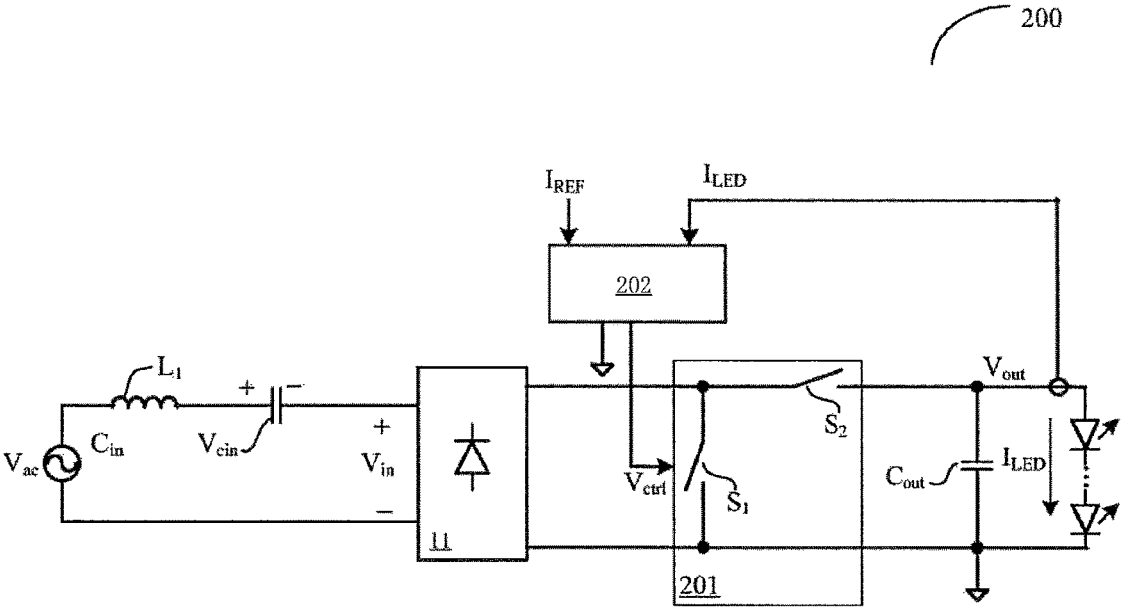
FIG. 2 illustrates a schematic block diagram of a capacitor step-down LED driver according to a first embodiment of the present disclosure.

FIG. 2 illustrates a schematic block diagram of a capacitor step-down LED driver according to a first embodiment of the present disclosure. In this embodiment, the capacitor step-down LED driver 200 is used for driving a LED load. Compared with the conventional capacitor step-down LED driver shown in FIG. 1, the capacitor step-down LED driver 200 further comprises a switching circuit 201 and a control circuit 202 for controlling energy being supplied from an input side to an output side of the capacitor step-down LED driver 200.

A first terminal of the input capacitor $C_{in}$ is coupled to a first terminal of an AC power supply AC. A second terminal of the input capacitor $C_{in}$ is coupled an input terminal of a rectifier circuit 11. A second input terminal of the rectifier circuit 11 is coupled to a second terminal of the AC power supply AC. An output capacitor $C_{out}$ is coupled in parallel to the LED load. The switching circuit 201 is coupled between an output terminal of the rectifier circuit 11 and the output capacitor $C_{out}$.

The control circuit 202 receives an output current $I_{LED}$ and a desired driving current $I_{REF}$ to generate a corresponding control signal $V_{ctrl}$ for turning on or off the switching circuit 201.

The control circuit 202 controls the switching circuit 201 not to supply energy from an input side to an output side of the capacitor step-down LED driver 200 when the output current $I_{LED}$ of the capacitor step-down LED driver 200 is larger than the desired driving current $I_{REF}$. Or otherwise, the control circuit 202 controls the switching circuit 201 to supply energy from the input side to the output side of the capacitor step-down LED driver 200 when the output current $I_{LED}$ of the capacitor step-down LED driver 200 is less than the desired driving current $I_{REF}$. The feedback control accurately adjusts the output current $I_{LED}$ to maintain the output current $I_{LED}$ to be a value of the desired driving current $I_{REF}$. Meanwhile, this feedback control reduces power loss and improves operating efficiency. Meanwhile, variations of the AC power supply AC and the input capacitor $C_{in}$ will not change the LED driving current $I_{LED}$, resulting in increased stability and lifetime of the system.

Specifically, the switching circuit 201 comprises a first switch S1 coupled between two output terminals of the rectifier circuit 11.

The control circuit 202 generates a control signal $V_{ctrl}$ for turning on the first switch S1 when the output current $I_{LED}$ is larger than the desired driving current $I_{REF}$. In such case, the energy cannot be supplied from the input side to the output side. Instead, the energy circulates in a loop of the input AC power supply $V_{ac}$, the input capacitor Cin and the rectifier circuit 11 to decrease the output current $I_{LED}$ of the capacitor step-down LED driver.

The control circuit 202 generates a control signal for turning off the first switch S1 when the output current $I_{LED}$ is less than the desired driving current $I_{REF}$. That is, the energy is allowed to be supplied from the input side to the output side to increase the output current $I_{ED}$ to be a value of the desired driving current $I_{REF}$.

The switching circuit 201 further comprises a second switch S2 coupled in series between a positive output terminal of the rectifier circuit 11 and a positive output terminal of the output capacitor $C_{out}$.

The second switch S2 is turned on when a voltage at the positive output terminal of the rectifier circuit 11 is larger than the output voltage $V_{out}$ of the capacitor step-down LED driver. In such case, the energy is supplied from the input side to the output side when the output current $I_{LED}$ is less than desired driving current $I_{REF}$. That is, the energy is supplied from the AC power supply $V_{ac}$ at the input side to the output capacitor $C_{out}$ at the output side through the rectifier circuit 11 to increase the output current $I_{LED}$ of the capacitor step-down LED driver.

Here, the second switch S2 may be any type of power switch, such as a diode, a controllable switch, and the like.

Moreover, a large surge current may occur in the operation of the system, especially at the moment when the switching circuit 201 is turned on. The large surge current, if it is not limited, may cause damages to the components in the system or even failure of the system. Thus, a certain surge current limiting circuit should be incorporated to avoid this. In this embodiment, a surge current limiting circuit is coupled in series between the AC power supply $V_{ac}$ and the input capacitor $C_{in}$ to limit the surge current at the moment when the switching circuit 201 is turned on. The surge current limiting circuit may comprises an inductor L1. Alternatively, the surge current limiting circuit may be arranged elsewhere in the system, for example, at the interconnect between the output terminal of the rectifier circuit 11 and the switching circuit.

Here, the control circuit 202 and a main circuit of the capacitor step-down LED driver 200 may be at the same potential.

Compared with the prior art, the capacitor step-down LED driver according to the embodiment of the present disclosure has an controllable output electrical signal, such as an output current or an output voltage. It adjusts the output electrical signal by feedback control in response to the current output electrical signal. The output electrical signal is maintained to be constant, resulting in reduced power loss and increased operation efficiency. Meanwhile, variations of the AC power supply and the input capacitor will not change the LED driving current, resulting in increased stability and lifetime of the circuit.

Figure 3A:
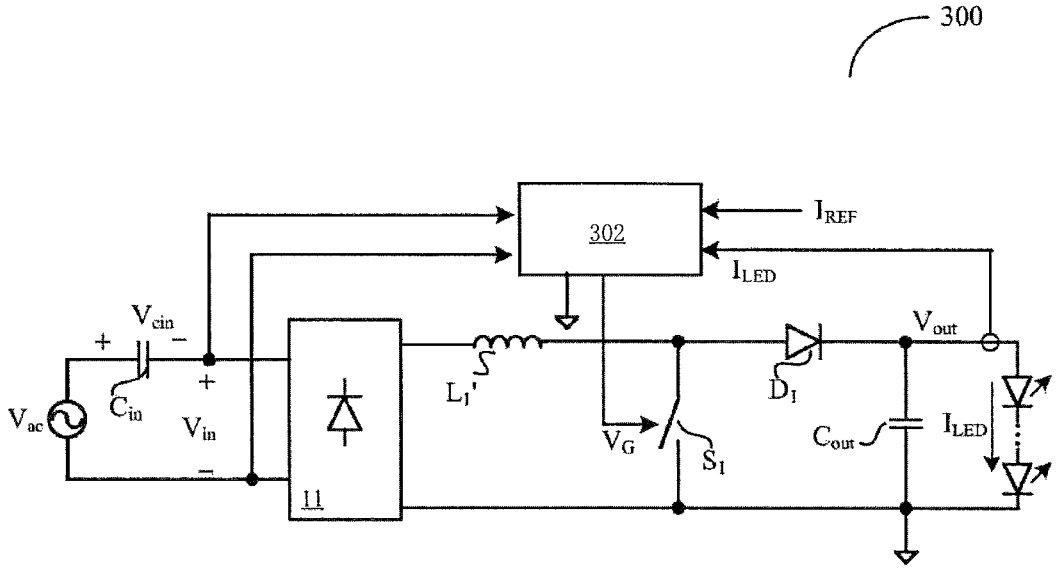
FIG. 3A illustrates a schematic block diagram of a capacitor step-down LED driver according to a second embodiment of the present disclosure.

FIG. 3A illustrates a schematic block diagram of a capacitor step-down LED driver according to a second embodiment of the present disclosure.

In this embodiment, the second switch S2 in the capacitor step-down LED driver 300 is a unidirectional switch to ensure that the second switch S2 is turned on to allow the energy to be supplied from the input side to the output side only when the input voltage $V_{in}$ is larger than the output voltage $V_{out}$. The second switch S2 is always turned off to prevent the energy from being inversely supplied from the output side to the input side when the input voltage $V_{in}$ is less than the output voltage $V_{out}$. Here, the second switch S2 comprises a diode D1.

Moreover, frequently turning the first switch S1 on and off causes high conduction loss and high electromagnetic interference (EMI). The conduction loss may be greatly reduced by turning on the first switch S1 at a zero voltage. In this embodiment, the control circuit 302 detects the input voltage $V_{in}$ of the rectifier circuit 11 in real-time. The first switch S1 is turned on when the input voltage $V_{in}$ crosses zero, so that the first switch S1 is synchronized in phase to the input voltage $V_{in}$ to reduce the conduction loss and EMI of the first switch S1.

The first switch S1 is turned off in accordance with a time period indicative of an error between the current output current $I_{LED}$ and the desired driving current $I_{REF}$. The time period is obtained from a ramp signal $V_{RAMP}$ and a compensation signal $V_{COMP}$ indicative of the error between the output current $I_{LED}$ and the desired driving current $I_{REF}$.

Figure 3B:
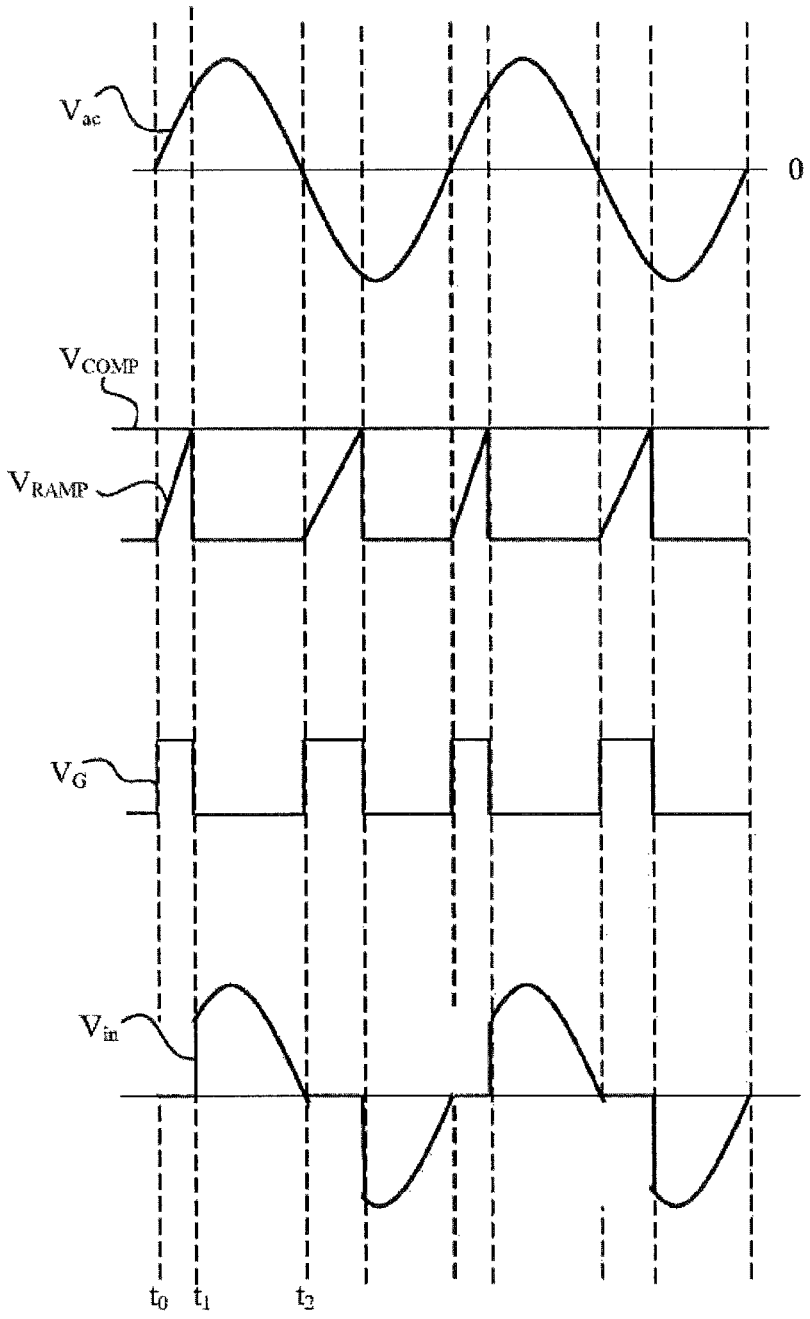
FIG. 3B illustrates a waveform diagram showing example operation of the capacitor step-down LED driver of FIG. 3A.

FIG. 3B illustrates a waveform diagram showing example operation of the capacitor step-down LED driver 300 of FIG. 3A.

The input voltage $V_{in}$ of the rectifier circuit 11 is proportional to the AC power supply $V_{ac}$, with the same waveform, when the first switch S1 is turned off. Accordingly, the input voltage $V_{in}$ of the rectifier circuit 11 crosses zero when the AC power supply $V_{ac}$ crosses zero at time t0. Meanwhile, the control circuit 302 generates a driving signal $V_G$ with a high level to turn on the first switch S1. The ramp signal $V_{RAMP}$ increases continuously from zero, while the input voltage $V_{in}$ maintains zero. At time t1, the ramp signal $V_{RAMP}$ increases to a value of the compensation $V_{COMP}$, and the driving signal $V_G$ changes to a low level to turn off the first switch S1. The input voltage $V_{in}$ follows the AC power supply $V_{ac}$ again. The first switch S1 is turned on and off periodically in accordance with the error between the current LED driving current and the desired driving current to maintain the LED driving current $I_{LED}$ to be constant.

In this embodiment, a surge limiting circuit with an inductor L1' is also coupled in series between a positive output terminal of the rectifier circuit 11 and a first terminal of the first switch S1.

Figure 4A:
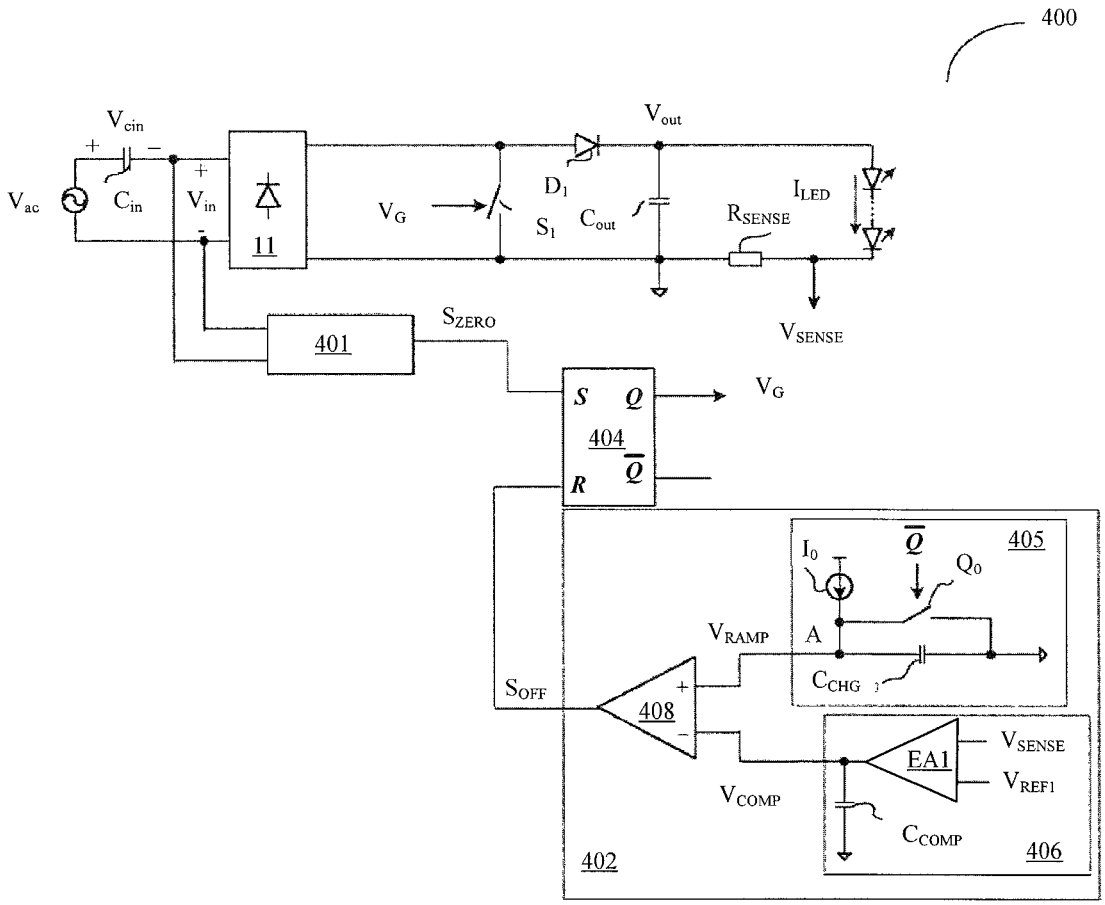
FIG. 4A illustrates a schematic block diagram of a capacitor step-down LED driver according to a third embodiment of the present disclosure.

FIG. 4A illustrates a schematic block diagram of a capacitor step-down LED driver according to a third embodiment of the present disclosure. The schematic block diagram of the control circuit of the capacitor step-down LED driver and its operation principle will be explained in detail in this embodiment.

The control circuit comprises a zero-crossing signal generating circuit 401, an OFF signal generating circuit 402 and a logic circuit. The logic circuit comprises an RS flip-flop 404. An input terminal of the zero-crossing signal generating circuit 401 receives the input voltage $V_{in}$, and generates a zero-crossing signal $S_{ZERO}$ when the input voltage $V_{in}$ crosses zero. The zero-crossing signal $S_{ZERO}$ sets the RS flip-flop 404 when the input voltage $V_{in}$ crosses zero, which in turn provides a control signal $V_G$ at terminal Q to turn on the first switch S1 by a corresponding driving circuit so that the energy is prevented from being supplied from the input side to the output side.

The OFF signal generating circuit 402 is configured to provide a time period for turning off the first switch S1 to allow the energy to be supplied from the input side to the output side, when the time period has elapsed after the first switch S1 is turned on. The time period is indicative of an error between the current output current $I_{LED}$ and the desired driving current $I_{REF}$.

In this embodiment, a detection resistor $R_{SENSE}$ is coupled in series to the LED load to generate a detection voltage signal $V_{SENSE}$ across the detection resistor $R_{SENSE}$, which is indicative of the output current $I_{LED}$. A reference voltage $V_{REF1}$ is indicative of the desired driving current $I_{REF}$.

The OFF signal generating circuit 402 comprises a compensation signal generating circuit 406 and a ramp signal generating circuit 405.

The compensation signal generating circuit 406 generates a compensation signal $V_{comp}$ indicative of an error between the current LED driving current and the desired driving current in accordance with the detection voltage signal $V_{SENSE}$ and the reference voltage $V_{REF1}$. Specifically, the compensation signal generating circuit 406 comprises an error amplifier EA1 and a compensation capacitor $C_{COMP}$ coupled to an output terminal of the error amplifier EA1. The error amplifier EA1 has two input terminals for receiving the detection voltage $V_{SENSE}$ and the reference voltage $V_{REF1}$ respectively, and has an output terminal for providing an output signal, which is then compensated by the compensation capacitor $C_{COMP}$ to generate a compensation signal $V_{COMP}$.

The ramp signal generating circuit 405 is configured to generate a ramp signal $V_{RAMP}$ which increases continuously after the first switch S1 is turned on. Specifically, the ramp signal generating circuit 405 comprises a current source $I_0$, a capacitor $C_{CHG}$ coupled in series to the current source $I_0$, and a switch $Q_0$ coupled in parallel to the capacitor $C_{CHG}$. The switching state of the switch $Q_0$ is controlled by an inverse version of the control signal $V_G$. The current source $I_0$ charges the capacitor $C_{CHG}$ when the first switch S1 is turned on, and the ramp signal $V_{RAMP}$ at a common node A between the current source $I_0$ and the capacitor $C_{CHG}$ increases continuously. A comparator 408 compares the received ramp signal $V_{RAMP}$ with the received compensation signal $V_{COMP}$. When the ramp signal $V_{RAMP}$ increases to a value of the compensation signal $V_{COMP}$, an output signal $S_{OFF}$ of the comparator 408 resets the RS flip-flop 404 to turn off the first switch S1.

Figure 4B:
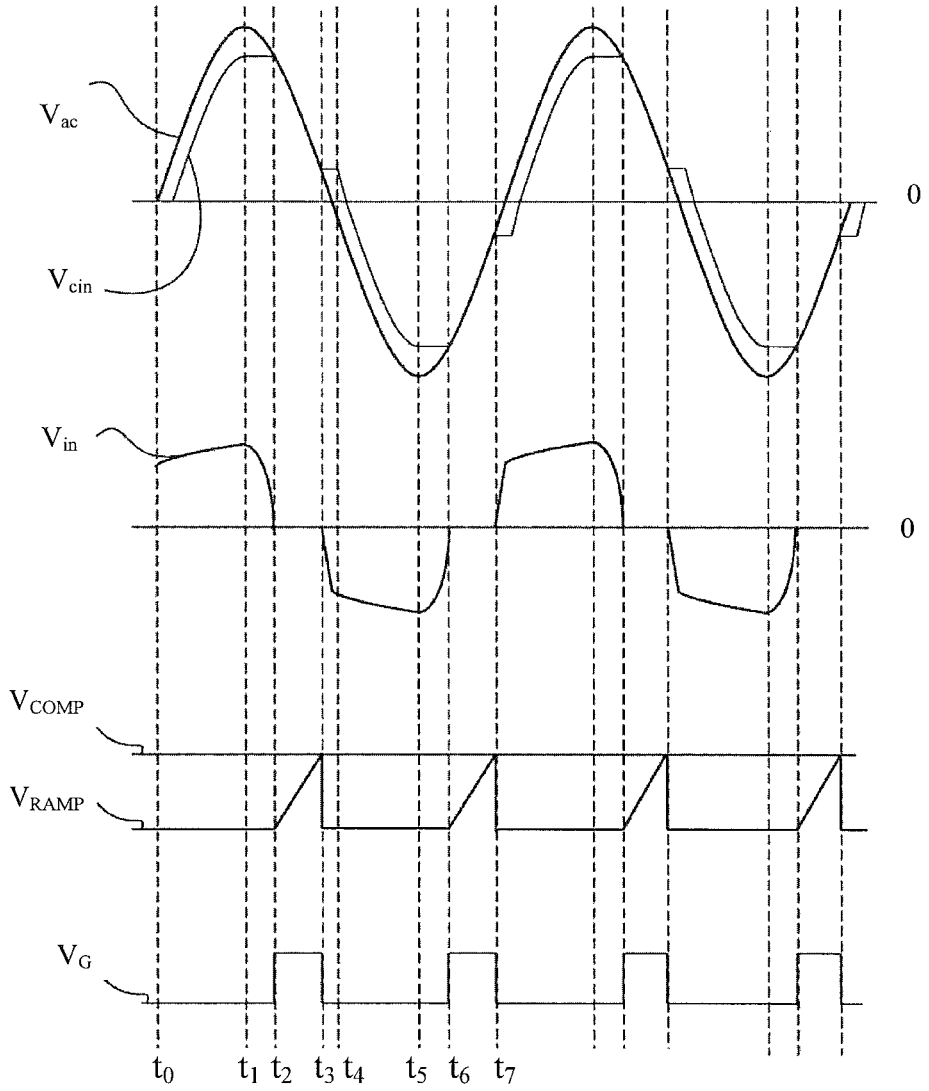
FIG. 4B illustrates a waveform diagram showing example operation of the capacitor step-down LED driver of FIG. 4A.

FIG. 4B illustrates a waveform diagram showing example operation of the capacitor step-down LED driver of FIG. 4A. The operation principle of the capacitor step-down LED driver 400 will be explained in detail with reference to its operation waveform.

In a state that the first switch S1 is turned off, for example, from time t0 to time t1, the input voltage $V_{in}$ is larger than the output voltage $V_{out}$, and the diode D1 is in a forward conduction state. The input capacitor $C_{in}$ and the output capacitor $C_{out}$ are coupled in series across the AC power supply $V_{ac}$. Thus, the waveform of the input capacitor voltage $V_{cin}$ is the same as that of the AC power supply $V_{ac}$, and the value of the input capacitor voltage $V_{cin}$ is proportional to the value of the AC power supply $V_{ac}$. The value of the input voltage $V_{in}$, increases continuously. At time t1, the input capacitor voltage $V_{cin}$ and the AC power supply $V_{ac}$ both reach a maximum value. From time t1 to t2, the AC power supply $V_{ac}$ decreases, but the input capacitor voltage $V_{cin}$ is maintained to be constant. At time t2, the AC power supply $V_{ac}$ decreases to a value of the input capacitor voltage $V_{cin}$, and the input voltage $V_{in}$ decreases rapidly to zero. Meanwhile, the control signal $V_G$ is changed to a high level and the first switch S1 is turned on. The ramp signal $V_{RAMP}$ increases continuously from zero. At time t3, the ramp signal $V_{RAMP}$ increases to a value of the compensation signal $V_{COMP}$, and the control signal $V_G$ is changed to a low level and the first switch S1 is turned off. In a time period from t2 to t3, the first switch S1 is turned on, and the input capacitor voltage $V_{cin}$ follows the AC power supply $V_{ac}$. Thus, the input voltage $V_{in}$ is maintained to be zero. In a time period from t3 to t4, the input voltage $V_{in}$ is less than the output voltage $V_{out}$, and the diode D1 is in an off state. Thus, the input capacitor voltage $V_{cin}$ is maintained to be constant. At time t4, the input voltage $V_{in}$ is larger than the output voltage $V_{out}$, the diode D1 begins to conduct. The input capacitor voltage $V_{cin}$ is again proportional to a value of the AC power supply $V_{ac}$ until time t5. According to the same principle, the input voltage $V_{in}$ is changed to zero at time t6 during the negative half cycle of the AC power supply $V_{ac}$, the first switch S1 is turned on again until time t7. The conduction time of the first switch S1 is repeatedly adjusted in accordance with an error between the current LED driving current and the desired driving current, so that the LED driving current is always maintained to be a value of the desired driving current.

The ramp signal generating circuit, the compensation signal generating circuit, and an example of the detection voltage signal indicative of the LED driving current are explained in detail in conjunction with the preferred embodiments. It is apparent for those skilled in the art that other implements can also be applied in the present disclosure.

Figure 5:
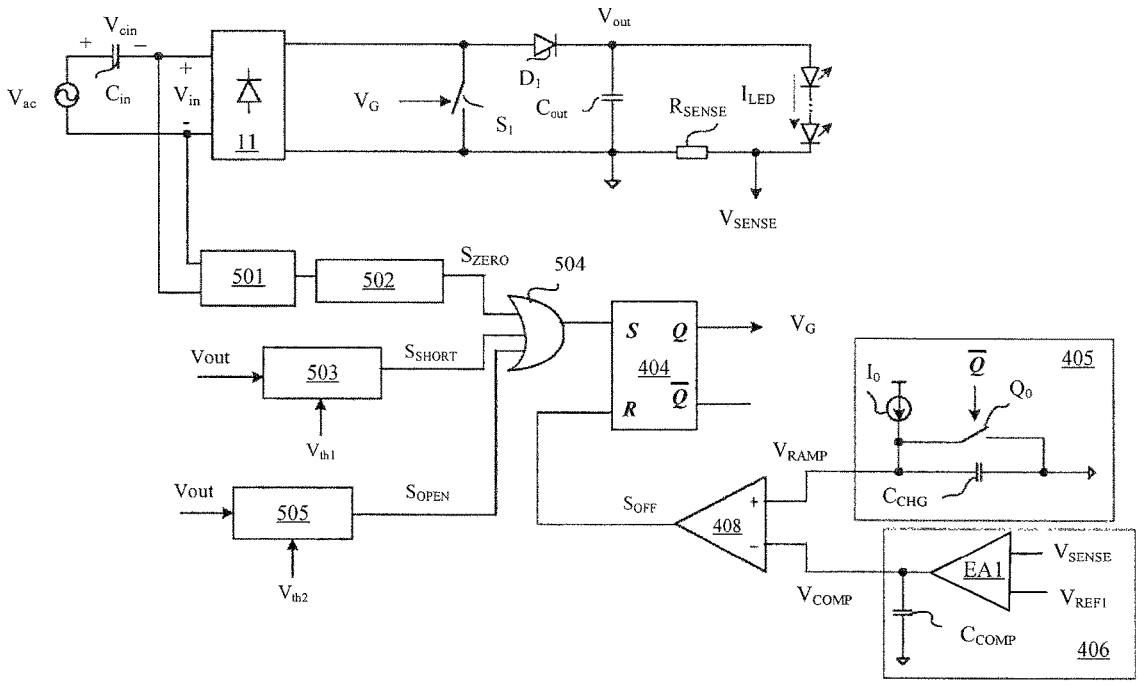
FIG. 5 illustrates a schematic block diagram of a capacitor step-down LED driver according to a fourth embodiment of the present disclosure.

FIG. 5 illustrates a schematic block diagram of a capacitor step-down LED driver according to a fourth embodiment of the present disclosure. Compared with the embodiment shown in FIG. 4, the capacitor step-down LED driver 500 shown in FIG. 5 further comprises a LED short circuit protection circuit 503 and a LED open circuit protection circuit 505.

The LED short circuit protection circuit 503 receives the output voltage $V_{out}$ and a first threshold voltage $V_{th1}$, and provides a short circuit protection signal $S_{SHORT}$. The LED open circuit protection circuit 505 receives the output voltage $V_{out}$ and a second threshold voltage $V_{th2}$, and provides an open circuit protection signal $S_{OPEN}$.

A OR gate 504 has three input terminals for receiving the zero-crossing signal $S_{ZERO}$ output from the zero-crossing signal generating circuit, a short circuit protection signal $S_{SHORT}$ and an open circuit protection signal $S_{OPEN}$, respectively. The OR gate 504 provides an output signal to the RESET terminal S of the RS flip-flop 404 to turn on the first switch S when the input voltage $V_{in}$ crosses zero, or when the LED load is short circuited, or when the LED load is open circuited. When the output voltage $V_{out}$ is less than the first threshold voltage $V_{th1}$, which indicates short circuit of the LED load, the first switch S1 is turned on to prevent the energy to be supplied from the input power supply to the output side. When the output voltage $V_{out}$ is larger than the second threshold voltage $V_{th2}$, which indicates open circuit of the LED load, the first switch S1 is also turned on to prevent the energy to be supplied from the input power supply to the output side.

It is apparent that other implements of the short circuit protection of the LED load can also be applied in the present disclosure. For example, the control circuit is disabled in response to the short circuit protection signal $S_{SHORT}$ when the LED load is short circuited.

On the other hand, the switching state of the first switch can also be controlled in response to the open circuit protection signal $S_{OPEN}$ for the open circuit protection. For example, an AND gate 506 provides an output signal to the RESET terminal R of the RS flip-flop 404 to control the switching state of the first switch S1 when the ramp signal $V_{RAMP}$ is larger than the compensation signal $V_{COMP}$ and the LED load is not open circuited. The first switch S1 will not be turned off even in a case that the ramp signal $V_{RAMP}$ is larger than the compensation signal $V_{COMP}$, when the output signal $V_{out}$ is larger than the second threshold voltage $V_{th2}$, which indicates that the LED load is open circuited. It ensures that the energy is not supplied from the input side to the output capacitor $C_{out}$, and prevents the output capacitor $C_{out}$ from exploding due to an excessively high voltage across the output capacitor $C_{out}$.

An example of the zero-crossing signal generating circuit is also given in this embodiment. The zero-crossing signal generating circuit comprises a zero-crossing signal detection circuit 501 and a single pulse signal generating circuit 502. The zero-crossing detection circuit 501 provides an output signal to the single pulse signal generating circuit 502 to output a single pulse signal as a zero-crossing signal $S_{ZERO}$, when the input voltage $V_{in}$ crosses zero.

In an example, the LED short circuit protection circuit 503 comprises a first comparator having two input terminals for receiving the output voltage $V_{out}$ and a first threshold voltage indicative of short circuit of the LED load respectively. In a case that the output voltage is less than the first voltage threshold voltage, it is indicative of short circuit of the LED load.

Similarly, the LED open circuit protection circuit 505 comprises a second comparator having two input terminals for receiving the output voltage $V_{out}$ and a second threshold voltage indicative of open circuit of the LED load respectively. In a case that the output voltage is larger than the second voltage threshold voltage, it is indicative of open circuit of the LED load.

Here, a resistor divider network may also be used for sampling the output voltage. The above threshold voltages will be changed accordingly.

Figure 6:
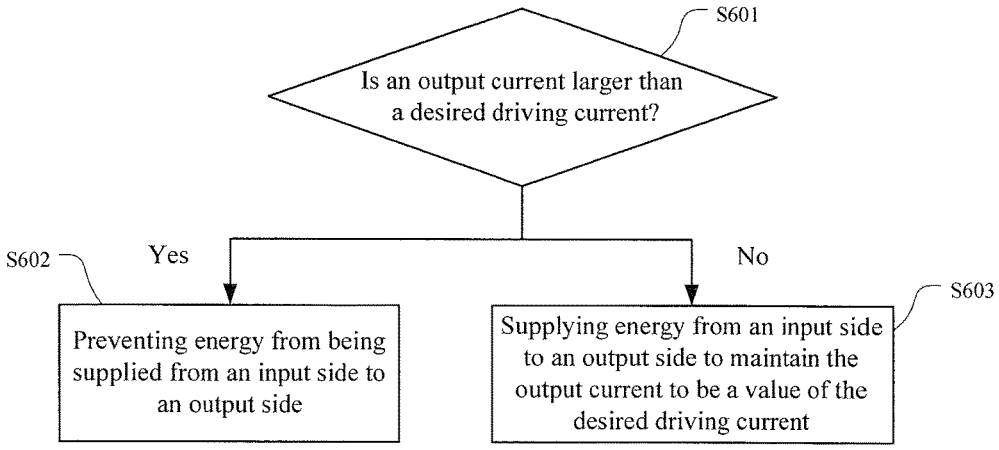
FIG. 6 illustrates a flow diagram of a driving method using a capacitor step-down LED driver according to an embodiment of the present disclosure.

A driving method using a capacitor step-down LED driver according to an embodiment of the present disclosure will be explained in detail in conjunction with the preferred embodiments. FIG. 6 illustrates a flow diagram of a driving method using a capacitor step-down LED driver according to an embodiment of the present disclosure.

In this embodiment, the driving method using the capacitor step-down LED driver to generate an output voltage and an output current for driving a LED load, comprising:

S601: comparing the output current and a desired driving current;

S602: preventing energy from being supplied from an input side to an output side of the capacitor step-down LED driver when the output current is larger than the desired driving current; and S603: supplying energy from the input side to the output side to maintain the output current to be a value of the desired driving current when the output current is less than the desired driving current.

Preferably, the step S603 of supplying energy from the input side to the output side further comprises:

comparing a rectified output voltage of the capacitor step-down LED driver and the output voltage;

preventing energy from being supplied from the input side to the output side when the rectified output voltage is less than the output voltage;

supplying energy from the input side to the output side to maintain the output current to be a value of the desired driving current when the rectified output current is larger than the desired output voltage.

Preferably, the step S602 of preventing energy from being supplied from the input side to the output side further comprises:

detecting an input voltage of the rectifier circuit of the capacitor step-down LED driver;

preventing energy from being supplied from the input side to the output side from the moment the input voltage crosses zero; and supplying energy from the input side to the output side after a time period indicative of an error between the current output current and the desired driving current has elapsed.

According to an embodiment of the present disclosure, the step of generating the time period may comprise:

generating a compensation signal in accordance with an error between the current output current and the desired driving current;

In each switching cycle, the time period is from the moment the energy is prevented from being supplied from the input side to the output side and the ramp signal increases continuously from zero, to the moment the ramp signal reaches a value of the compensation signal.

In this embodiment, the driving method using the capacitor step-down LED driver further comprising limiting a surge current at the input side by using a magnetic component, which otherwise occurs when the switch is turned on and causes damages to the components in the circuit.

In this embodiment, the driving method using the capacitor step-down LED driver further comprising preventing energy from being supplied from the input side to the output side when the LED load is short circuited.

Here, determination of the short circuit of the LED load comprises:

comparing the output voltage with a first threshold voltage;

the LED load is short circuited in a case that the output voltage is less than the first threshold voltage.

In a case that the LED load is short circuited, one protection measure includes disabling the control circuit of the capacitor step-down LED driver.

In this embodiment, the driving method using the capacitor step-down LED driver further comprising preventing energy from being supplied from the input side to the output side when the LED load is open circuited.

Here, determination of the open circuit of the LED load comprises:

comparing the output voltage with a second threshold voltage;

the LED load is open circuited in a case that the output voltage is larger than the second threshold voltage.

In a case that the LED load is open circuited, the energy is prevented from being supplied from the input side to the output side. The output capacitor at the output side is well protected from exploding due to an excessively high voltage across the output capacitor.

In this embodiment, the driving method using the capacitor step-down LED driver further comprising limiting a surge current by using a magnetic component, which otherwise occurs at the input side when the switch change its switching state.

It should be understood that components in various embodiments may have the same function if they have the same name. A modified embodiment may incorporate elements in several relevant embodiments, though it may be described in connection with one of the previous embodiments. It is apparent for those skilled in the art, after reading the preferred embodiments of the present disclosure and without introducing no creative work, that any suitable circuit structure can be applied to the present disclosure, for example, other zero-crossing signal generating circuits, other LED short circuit protection circuits, other LED open circuit protection circuits, other ramp signal generating circuit and other compensation signal generating circuits, and the like. Thus, modifications that may be made by those skilled in the art, after reading the preferred embodiments, may be included within the spirit and scope of the invention.

It should also be understood that the relational terms such as "first", "second", and the like are used in the context merely for distinguishing one element or operation form the other element or operation, instead of meaning or implying any real relationship or order of these elements or operations. Moreover, the terms "comprise", "comprising" and the like are used to refer to comprise in nonexclusive sense, so that any process, approach, article or apparatus relevant to an element, if follows the terms, means that not only said element listed here, but also those elements not listed explicitly, or those elements inherently included by the process, approach, article or apparatus relevant to said element. If there is no explicit limitation, the wording "comprise a/an . . . " does not exclude the fact that other elements can also be included together with the process, approach, article or apparatus relevant to the element.

Although various embodiments of the present invention are described above, these embodiments neither present all details, nor imply that the present invention is limited to these embodiments. Obviously, many modifications and changes may be made in light of the teaching of the above embodiments. These embodiments are presented and some details are described herein only for explaining the principle of the invention and its actual use, so that one skilled person can practice the present invention and introduce some modifications in light of the invention. The invention is intended to cover alternatives, modifications and equivalents that may be included within the spirit and scope of the invention as defined by the appended claims.

What is claimed is:

1. A capacitor step-down LED driver for receiving an AC power supply at an input side and generating an output voltage and an output current at an output side to drive a LED load, comprising an input capacitor, a rectifier circuit, an output capacitor, a control circuit and a switching circuit, wherein a first terminal of said input capacitor is coupled to a first terminal of said AC power supply, a second terminal of said input capacitor is coupled to a first input terminal of said rectifier circuit, and a second input terminal of said rectifier circuit is coupled to a second terminal of said AC power supply;

said output capacitor is coupled in parallel to said LED load;

said switching circuit is coupled between output terminals of said rectifier circuit and said output capacitor;

said control circuit turns on or off said switching circuit in response to said output current, and thus controls an amount of energy supplied from said input side to said output side, so as to compensate variations of said AC power supply and said input capacitor to maintain said output current to be a value of said desired driving current, wherein said switching circuit is controlled not to supply energy from said input side to said output side in a first operation state when said output current is larger than a desired driving current by circulating said energy in a loop of said AC power supply, said input capacitor and said rectifier circuit to decrease said output of current of said capacitor step-down LED driver; and said switching circuit is controlled to supply energy from said input side to said output side in a second operation state when said output current is less than said desired driving current to increase said output current.

2. The capacitor step-down LED driver according to claim 1, wherein said switching circuit comprises a first switch coupled between two output terminals of said rectifier circuit, and said first switch is turned on in said first operation state and is turned off in said second operation state, and a diode coupled in series between said first switch and said output capacitor.

3. The capacitor step-down LED driver according to claim 1, further comprising a surge current limiting circuit for limiting a surge current when said switching circuit is turned on.

4. The capacitor step-down LED driver according to claim 3, wherein said surge current limiting circuit comprises a magnetic component.

5. The capacitor step-down LED driver according to claim 3, wherein said surge current limiting circuit is coupled between said AC power supply and said input capacitor.

6. The capacitor step-down LED driver according to claim 3, wherein said surge current limiting circuit is coupled between said output terminal of said rectifier circuit and said switching circuit.

7. The capacitor step-down LED driver according to claim 1, wherein said control circuit comprises a zero-crossing signal generating circuit and an OFF signal generating circuit;

said zero-crossing signal generating circuit generates a zero-crossing signal in response to an input voltage of said rectifier circuit of said capacitor step-down LED driver, and said switching circuit prevents energy from being supplied from said input side to said output side in response to said zero-crossing signal when said input voltage crosses zero; and said OFF signal generating circuit generates an OFF signal after a time period in accordance with an error between said current output current and said desired driving current, to allow energy to be supplied from said input side to said output side.

8. The capacitor step-down LED driver according to claim 1, wherein said switching circuit comprises:

a first switch coupled between two output terminals of said rectifier circuit, and said first switch is turned on in said first operation state and is turned off in said second operation state, and a second switch coupled in series between said first switch and said output capacitor, and said second switch is turned on when a rectified output voltage of said rectifier circuit is larger than said output voltage in said second operation state.

9. The capacitor step-down LED driver according to claim 8, further comprising a LED short circuit protection circuit, wherein said control circuit turns on said first switch to prevent energy from being supplied from said input side to said output side when said LED load is short circuited.

10. The capacitor step-down LED driver according to claim 9, said LED short circuit protection circuit receives said output voltage and a first threshold voltage, wherein said LED short circuit protection circuit generates a short circuit protection signal to turn on said first switch when said output voltage is less than said first threshold voltage in a case that said LED load is short circuited.

11. The capacitor step-down LED driver according to claim 8, further comprising a LED open circuit protection circuit, wherein said control circuit turns on said first switch to prevent energy from being supplied from said input side to said output side when said LED load is open circuited.

12. The capacitor step-down LED driver according to claim 11, said LED open circuit protection circuit receives said output voltage and a second threshold voltage, wherein said LED open circuit protection circuit generates an open circuit protection signal to turn on said first switch when said output voltage is larger than said second threshold voltage in a case that said LED load is open circuited.

13. A driving method using a capacitor step-down LED driver having a rectifier circuit and a switching circuit coupled between two output terminals of said rectifier circuit, and configured to generate an output voltage and an output current for driving a LED load, comprising comparing said output current and a desired driving current; and turning on or off said switching circuit in response to said output current, and thus controls an amount of energy supplied from said input side to said output side, so as to compensate variations of an AC power supply and an input capacitor to maintain said output current to be a value of said desired driving current, wherein said switching circuit is controlled not to supply energy from an input side to an output side of said capacitor step-down LED driver by turning on said switching circuit when said output current is larger than said desired driving current, said energy circulates in a loop of said AC power supply, said input capacitor and said rectifier circuit to decrease said output current of said capacitor step-down LED driver; and said switching circuit is controlled to supply energy from said input side to said output side to maintain said output current to be a value of said desired driving current by turning off said switching circuit when said output current is less than said desired driving current to increase said output current.

14. The driving method according to claim 13, further comprising limiting a surge current at said input side by using a magnetic component.

15. The driving method according to claim 13, wherein said step of supplying energy from said input side to said output side further comprises:

comparing a rectified output voltage of said capacitor step-down LED driver and said rectified output voltage;

preventing energy from being supplied from said input side to said output side when said rectified output voltage is less than said output voltage;

supplying energy from said input side to said output side to maintain said output current to be a value of said desired driving current when said rectified output voltage is larger than said output voltage.

16. The driving method according to claim 13, wherein said step of preventing energy from being supplied from said input side to said output side further comprises:

detecting an input voltage of said rectifier circuit of said capacitor step-down LED driver;

preventing energy from being supplied from said input side to said output side from the moment said input voltage crosses zero; and supplying energy from said input side to said output side after a time period indicative of an error between said current output current and said desired driving current has elapsed.

17. The driving method according to claim 13, further comprising preventing energy from being supplied from said input side to said output side when said LED load is short circuited.

18. The driving method according to claim 13, further comprising preventing energy from being supplied from said input side to said output side when said LED load is open circuited.

* * * * *